US006092742A

United States Patent [19]

Miner, Jr. et al.

[11] Patent Number: 6,092,742

[45] Date of Patent: Jul. 25, 2000

[54] NOZZLE FOR SPRAYING LIQUIDS

[75] Inventors: Frank Henry Miner, Jr., North Olmsted; Mark Thomas Arthur, Lakewood, both of Ohio

[73] Assignee: South Carolina Systems, Inc., El Dorado, Ark.

[21] Appl. No.: 09/135,741

[22] Filed: Aug. 18, 1998

[51] Int. Cl.[7] ..... B05B 1/34

[52] U.S. Cl. ..... 239/468; 239/600

[58] Field of Search ..... 239/461, 463, 239/468, 469, 491, 589, 590, 600

[56] References Cited

U.S. PATENT DOCUMENTS

| | | | |
|---|---|---|---|
| 580,151 | 4/1897 | Barnard | 239/469 |
| 1,293,108 | 2/1919 | Judson | 239/468 |
| 1,961,408 | 6/1934 | Wahlin | 239/468 |
| 2,358,177 | 9/1944 | Madison | 239/469 |
| 2,550,573 | 4/1951 | Lyman | 239/468 |
| 3,326,473 | 6/1967 | Wahlin | 239/469 X |
| 3,762,652 | 10/1973 | Huling | 239/469 |
| 4,092,003 | 5/1978 | Ikeuchi | 239/590 |
| 4,426,041 | 1/1984 | Nieuwkamp et al. | 239/468 |
| 4,664,314 | 5/1987 | O'Brien | 239/469 |

FOREIGN PATENT DOCUMENTS

| | | | |
|---|---|---|---|
| 689691 | 9/1930 | France | 239/469 |
| 2604264 | 2/1977 | Germany . | |
| 589030 | 1/1978 | Russian Federation . | |
| 638383 | 12/1978 | Russian Federation . | |
| 85553 | 2/1936 | Sweden | 239/468 |
| 625718 | 10/1981 | Switzerland | 239/469 |
| 585884 | 12/1977 | United Kingdom . | |

*Primary Examiner*—Lesley D. Morris
*Attorney, Agent, or Firm*—Frederick J. McCarthy

[57] ABSTRACT

Jet nozzle for providing a solid cone jet having a housing with a cylindrical bore with different sized removeable caps at each end, one cap having an outwardly flaring nozzle portion and the other cap having an inner surface with discrete raised portions. A washer with an integral key is provided to engage a notch as the fluid inlet means for the nozzle to lock the nozzle in a pre-determined orientation.

6 Claims, 2 Drawing Sheets

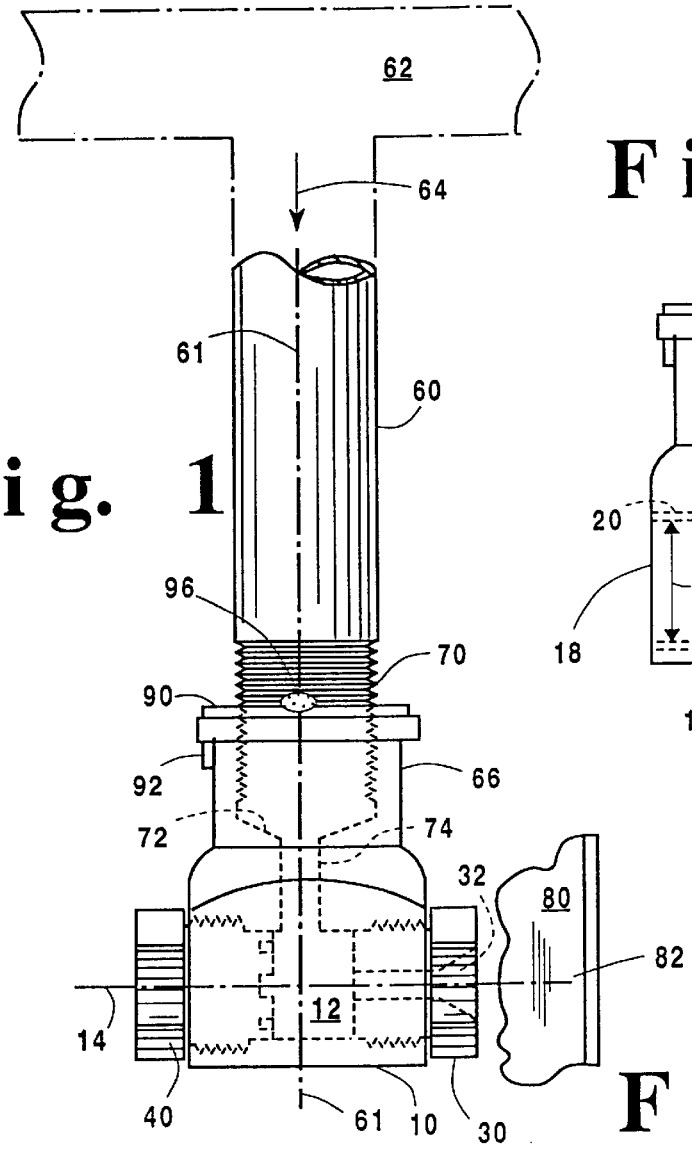
Fig. 1
Fig. 1B
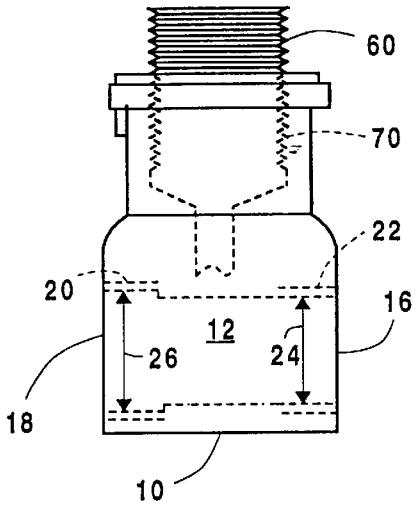
Fig. 1A
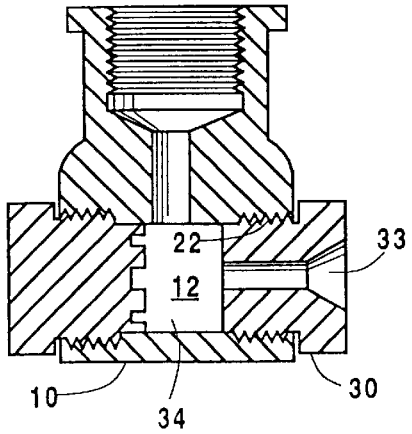
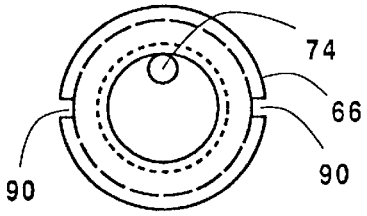
Fig. 1C

Fig. 1D
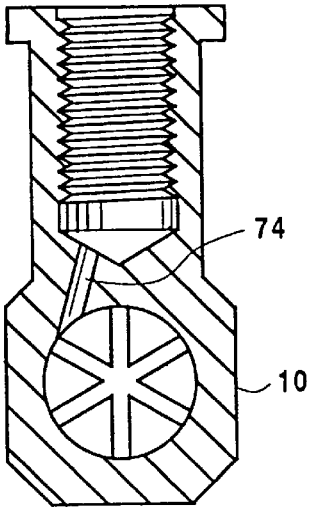
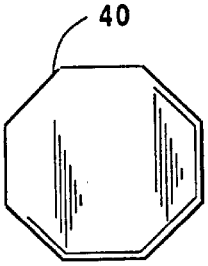
Fig. 2A
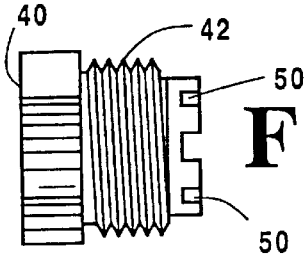
Fig. 2B
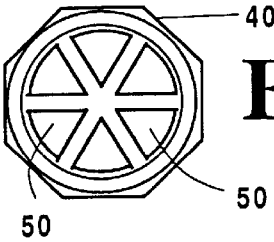
Fig. 2C
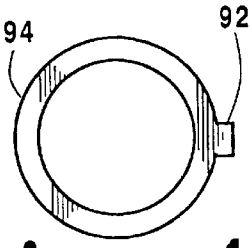
Fig. 4A
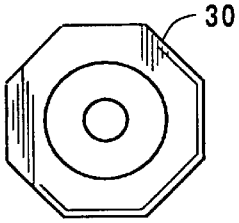
Fig. 3A
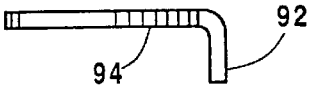
Fig. 4B
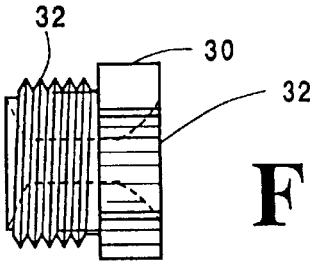
Fig. 3B

NOZZLE FOR SPRAYING LIQUIDS

FIELD OF THE INVENTION

The present invention relates to a solid-cone jet nozzle for spraying liquids, in particular a cooling liquid employed in thermally severe conditions such as spray-cooled electric arc furnaces.

BACKGROUND OF THE INVENTION

A solid-cone jet nozzle is described in U.S. Pat. No. 4,426,041, the disclosure of which is incorporated herein by reference. A nozzle of this type can be used effectively in the spray cooling of electric arc furnaces as described in U.S. Pat. No. 4,715,042 to Heggart et al (which is incorporated herein by reference) and in the spray cooling of hood assemblies of pneumatic process metallurgical vessels as described in U.S. Pat. No. 5,330,161 to Lehr et al (which is incorporated herein by reference).

In the thermally severe operating environments described in the Heggart et al and Lehr et al patents, it is a practical necessity to replace spray cooling nozzles on a regular basis for inspection, cleaning and adjustment.

SUMMARY OF THE INVENTION

The present invention is directed to a solid cone jet nozzle which includes a housing, suitably formed from a metal such as brass. The housing has a cylindrical bore which is open at both ends which are internally threaded. The internally threaded end portions are of different inner diameter. A liquid inlet means is provided integral with the housing and transverse to the bore of the housing and closed at its juncture with the bore of the housing except for a passage which extends into the cylindrical bore of the housing substantially tangential to the cylindrical bore of the housing. A separate first cap means having an outwardly flaring nozzle opening is provided which is threadably engageable with one end of the cylindrical bore in the housing. A separate second cap means is provided which is threadably engageable with the other end of the cylindrical bore of the housing which closes this end of the cylindrical bore. The inner surface of the second cap has discrete raised elevations which are adjacent to tangential passage of the liquid inlet means. The respective diameters of the threadable portions of the first and second caps are different so that each cap can be threadably engaged in only one end of the cylindrical bore of the housing.

In a further embodiment of the invention, a notch is provided in the fluid inlet means to receive a key which is integral with a washer seated at the remote end of the fluid inlet means. When a fluid supply inlet conduit is threadably engaged to the fluid inlet means the washer is affixed to the fluid supply inlet, e.g. by a weld, which prevents the housing from being easily and routinely disengaged from the fluid inlet supply.

BRIEF DESCRIPTION OF THE DRAWINGS

FIG. 1 is an elevation view of a nozzle in accordance with the present invention;

FIG. 1A is partial sectional elevation view of the nozzle of FIG. 1;

FIG. 1B is an elevation view of the housing element of FIG. 1;

FIG. 1C is a top view of the fluid inlet means shown in elevation of FIG. 1;

FIG. 1D is a transverse cross-section view of the housing element of FIG. 1;

FIGS. 2A–C show the outside, inside and elevation views for the solid threadable cap shown in FIG. 1;

FIGS. 3A, 3B show outside and elevation views of the nozzle outlet cap of FIG. 1; and FIGS. 4A, 4B show a plan and side elevation view of a keyed washer used in the present invention.

DETAILED DESCRIPTION OF THE INVENTION

With reference to FIGS. 1, 1A, 1B, 1C & 1D, a nozzle housing is shown at 10 having a cylindrical bore 12, which has a central longitudinal axis 14 and is open at both ends 16, 18 which are respectively internally threaded as shown at 20, 22. The internal diameter 24, 26 of threaded portions 20, 22 are different for reasons hereinafter described. Cap member 30, shown also in FIGS. 3A, 3B has an externally threaded portion 32 for removeably engaging the interior threaded portion 22 of cylindrical bore 12. Cap member 30 will not engage the threaded interior portion 20 of larger inner diameter at the opposite end of cylindrical bore 12. Cap member 30 has an outwardly flaring nozzle opening 33 which communicates with the chamber 34 in housing 10. Cap member 40, shown also in FIGS. 2A, 2B, 2C has an externally threaded portion 42 for removeably engaging the interior threaded portion 20 of cylindrical bore 12. Cap member 40 will not engage the threaded interior portion 22 of smaller inner diameter at the opposite end of cylindrical bore 12. Cap member 40 is solid, completely closing cylindrical bore 12 of the nozzle housing 10 when engaged and has an inner surface having integral discrete raised elevations 50. When fluid, e.g. cooling water is introduced through fluid supply conduit 60 having a central longitudinal axis 61 from a fluid supply header indicated at 62, as shown at 64, the fluid enters the fluid inlet means 66 which is integral with housing 10. Fluid inlet means 66 threadably engages fluid inlet conduit 60 as indicated at 70, remote from cylindrical bore 12.

The opposite end portion of fluid inlet means 66 is closed except for passage 74 which extends substantially tangentially into cylindrical bore 12 adjacent the raised elevations 50 on the interior surface of cap 40. With fluid, e.g. water entering cylindrical bore 12 tangentially through passage 74, turbulence is created by elevations 50 and rotation is developed due to the tangential flow with the result that a solid cone jet exits the outwardly flaring nozzle opening 32 as described in the above-noted U.S. Pat. No. 4,426,041. In the use of such a nozzle in spray cooling the wall of an electric arc furnace indicated schematically at 80, nozzles are directed to spray at a specific location e.g. as represented at 82. When it becomes necessary to replace caps 30 and 40, e.g. for inspection, cleaning, it is important that the spray from the replacement cap be directed precisely as before. This is assured since a new identical cap 30, containing flaring nozzle opening 32 will only engage the interior threaded section 22 and cannot be engaged at interior thread section 24 due to the difference in inner diameter as described above. Also, to ensure that housing 10 maintains its initial orientation with respect to furnace wall 80, fluid inlet 66 is provided with a peripheral notch 90, shown in FIG. 1C and FIG. 1, to receive the downwardly depending key portion 92 of washer 94 which rests on the open threaded end portion 70 of fluid inlet 66. The key portion 92 is welded at 96 to supply inlet conduit 60 and will prevent rotation of housing 12 when washer 94 is affixed to supply inlet conduit 60 by weld 96.

What is claimed is:

1. A solid cone jet nozzle comprising:

(i) a housing having a cylindrical bore with a central longitudinal axis which is open at its opposite terminal portions which are internally threaded, said respective internally threaded terminal portions having different internal diameters;

(ii) liquid inlet means integral with said housing having a cylindrical bore with a central longitudinal axis perpendicular to the central longitudinal axis of the cylindrical bore of said housing said liquid inlet means being open and internally threaded at its end which is distal from said housing and being closed at its end which is proximal said housing except for a passage which is displaced from the central longitudinal axis of the bore of said inlet means and which extends into the cylindrical bore of said housing substantially tangential to said cylindrical bore of said housing, said liquid inlet means being provided with an external notch at its open end which is distal from said housing and a washer seated at the open end of said liquid inlet means surrounding the cylindrical bore of said liquid inlet means said washer having an internal peripheral key which extends parallel to the central longitudinal axis of said cylindrical bore for engaging said external notch;

(iii) a first cap means having an outer terminal portion in the form of a flaring nozzle with an opening in line with the central longitudinal axis of the cylindrical bore of said housing and an oppositely extending externally threaded extension port to removeably threadably engage only one of said internally threaded terminal portions of said housing; and (iv) a second cap means having a closed outer terminal portion and an oppositely extending threaded extension which terminates in a surface having discrete raised elevation which is transverse to the central longitudinal axis of the cylindrical bore of said housing, said solid threaded extension being removeably threadably engageable only with the other of said internally threaded terminal portions of said housing.

2. A jet nozzle in accordance with claim 1 in combination with a fluid inlet conduit which is threadably engaged with the cylindrical bore of said liquid inlet means and affixed to said washer by a weld.

3. A solid cone jet nozzle comprising:

(i) a housing having a cylindrical bore with a central longitudinal axis which is open at its opposite terminal portions which are internally threaded;

(ii) liquid inlet means integral with said housing having a cylindrical bore with a central longitudinal axis perpendicular to the central longitudinal axis of the cylindrical bore of said housing said liquid inlet means being open and internally threaded at its end which is distal from said housing and being closed at its end which is proximal said housing except for a passage which is displaced from the central longitudinal axis of the bore of said inlet means and which extends into the cylindrical bore of said housing substantially tangential to said cylindrical bore of said housing, said liquid inlet means being provided with an external notch at its open end which is distal from said housing and a washer seated at the open end of said liquid inlet means surrounding the cylindrical bore of said liquid inlet means, said washer having an internal peripheral key which extends parallel to the central longitudinal axis of said cylindrical bore for engaging said external notch;

(iii) a first cap means having an outer terminal portion in the form of a flaring nozzle with an opening in line with the central longitudinal axis of the cylindrical bore of said housing and an oppositely extending externally threaded extension port to removeably threadably engage one of said internally threaded terminal portions of said housing; and (iv) a second cap means having a closed outer terminal portion and an oppositely extending threaded extension which terminates in a surface having discrete raised elevations which is transverse to the central longitudinal axis of the cylindrical bore of said housing, said solid threaded extension being removeably threadably engageable with the other of said internally threaded terminal portions of said housing.

4. A jet nozzle in accordance with claim 3 in combination with a fluid inlet conduit which is threadably engaged with the cylindrical bore of said liquid inlet means and affixed to said washer by a weld.

5. A solid cone jet nozzle comprising:

(i) a housing having a cylindrical bore with a central longitudinal axis which is open at its opposite terminal portions, at least one of said terminal portions being internally threaded to receive a threadably engageable extension of a cap means and the other terminal portion being in the form of a flaring nozzle with an opening in line with the central longitudinal axis of the cylindrical bore of said housing;

(ii) liquid inlet means integral with said housing having a cylindrical bore with a central longitudinal axis perpendicular to the central longitudinal axis of the cylindrical bore of said housing said liquid inlet means being open and internally threaded at its end which is distal from said housing and being closed at its end which is proximal said housing except for a passage which is displaced from the central longitudinal axis of the bore of said inlet means and which extends into the cylindrical bore of said housing substantially tangential to said cylindrical bore of said housing, said liquid inlet means being provided with an external notch at its open end which is distal from said housing and a washer seated at the open end of said liquid inlet means surrounding the cylindrical bore of said liquid inlet means, said washer having an internal peripheral key which extends parallel to the central longitudinal axis of said cylindrical bore for engaging said external notch; and (iii) cap means having a closed outer terminal portion and an oppositely extending threaded extension which terminates in a surface having discrete raised elevations which is transverse to the central longitudinal axis of the cylindrical bore of said housing, said solid threaded extension being removeably threadably engageable with a threaded terminal portion of said housing.

6. A jet nozzle in accordance with claim 5 in combination with a fluid inlet conduit which is threadably engaged with the cylindrical bore of said liquid inlet means and affixed to said washer by a weld.

* * * * *